US005697333A

United States Patent [19]

Church et al.

[11] Patent Number: 5,697,333

[45] Date of Patent: Dec. 16, 1997

[54] DUAL LIFT ACTUATION MEANS

[75] Inventors: Kynan L. Church, Ceresco; Keith Hampton, Ann Arbor; Jason J. McConnell, Jackson; Brian K. Van Deusen, Augusta, all of Mich.

[73] Assignee: Eaton Corporation, Cleveland, Ohio

[21] Appl. No.: 803,339

[22] Filed: Feb. 20, 1997

[51] Int. Cl.[6] ..... F01L 13/00

[52] U.S. Cl. ..... 123/90.16; 123/90.41; 123/198 F

[58] Field of Search ..... 123/90.11, 90.15, 123/90.16, 90.17, 90.27, 90.39, 90.41, 90.43, 90.45, 90.46, 198 F

[56] References Cited

U.S. PATENT DOCUMENTS 5,524,580 6/1996 Muir ..... 123/90.16
5,529,033 6/1996 Hampton ..... 123/90.16
5,584,267 12/1996 Muir ..... 123/90.39
5,619,958 4/1997 Hampton et al. ..... 123/90.16
5,623,897 4/1997 Hampton et al. ..... 123/90.16

*Primary Examiner*—Weilun Lo
*Attorney, Agent, or Firm*—L. J. Kasper

[57] ABSTRACT

A valve control system for an internal combustion engine including a poppet valve (21) and high lift (15) and low lilt (31) cam lobes. A latchable rocker arm includes an outer rocker arm (33) and an inner rocker arm (35), and a slider mechanism (37) which is biased by a spring (67) to the high lilt mode (FIG. 1). An actuator assembly (27) includes and arm (103) biased by a spring (101) into engagement with the slider (37), biasing the slider toward the unlatched (low lift) mode (FIG. 2 ). The actuator (27) includes an electromagnetic coil (83) which moves an armature (87) into engagement with the arm (103), biasing the arm in opposition to the force of the actuator spring (101), but aided initially by the force of the slider spring (67).

12 Claims, 4 Drawing Sheets

DUAL LIFT ACTUATION MEANS

BACKGROUND OF THE DISCLOSURE

The present invention relates to a valve operating apparatus for an internal combustion engine and, more particularly, to such an apparatus which causes the engine valve to operate, in either a high lilt mode or a low lift mode, in response to whether or not a solenoid actuator is energized.

Even more particularly, the present invention relates to a valve operating apparatus for use with a rocker arm assembly of the general type commonly referred to as a "latchable rocker arm", illustrated and described, by way of example only, in U.S. Pat. Nos. 5,529,033 and 5,584,267, assigned to the assignee of the present invention and incorporated herein by reference.

In one typical latchable rocker arm arrangement there is an inner rocker arm which is engageable with a cam lobe on an engine camshaft, and an outer rocker arm which is engageable with an engine popper valve. In addition, there is typically a slidable latch member which, in one position, mechanically links the inner and outer rocker arms for movement in unison, and in another position, permits the rocker arms to move relative to each other. Typically, when the rocker arms are unlatched, the engine poppet valve remains in its closed position. This arrangement is also referred to as a valve deactivation system (VDS), because the poppet valve either opens periodically in the normal manner or remains closed.

Although the present invention is useable with a valve control system of the VDS type, it is especially advantageous with a valve control system of the "dual lift" type, and will be described in connection therewith. In a typical dual lift system, each cam includes a high lift lobe and a low lift lobe, and which of the lobes is effective in opening the poppet valve is determined by whether or not the two rocker arms are latched together which, in turn is determined by whether or not the solenoid actuator is energized.

In the valve operating systems of the above-incorporated patents, the latchable member is normally biased to the latched position in which the inner and outer rocker arms move in unison, thus allowing the valve train to operate in its normal manner, opening the engine popper valve in a VDS system (or achieving the "high lift" mode in a dual lift system). In other words, it is necessary to energize the solenoid actuator in order to move the sliding latch member to its unlatched position, whereby the rocker arms are free to rotate (pivot) relative to each other, and the engine poppet valve remains seated in the VDS system (or operates in the "low lift" mode in the dual lift system).

Although the above-described conventional arrangement for operating a latchable rocker arm is generally satisfactory during normal operation, the conventional system does have one notable drawback. In the event that the solenoid actuator fails (e.g., if the coil burns out), the latchable rocker arm will operate only in the latched mode, which is normally intended to be used only at relatively higher engine speeds.

BRIEF SUMMARY OF THE INVENTION

Accordingly, it is an object of the present invention to provide an improved valve control system for a latchable rocker arm assembly wherein the latchable rocker arm will operate in the valve closed (or the low lift mode) in the event of a failure of the solenoid actuator.

The above and other objects of the invention are accomplished by the provision of an improved valve control system for an internal combustion engine including a cylinder head, a poppet valve moveable within the cylinder head between one condition and another condition, and a cam shaft including a cam lobe having a cam profile. The control system comprises a first rocker arm mounted relative to the cylinder head for rotation about an axis. A second rocker arm is mounted relative to the cylinder head for rotation about the axis, and one of the rocker arms is engageable with the poppet valve, and one of the rocker arms has a cam follower element thereon engageable with the cam lobe. A latch means is operable, in response to movement in a direction perpendicular to the axis, to a first position, to achieve mutual engagement of the first and second rocker arms, for rotation in unison about the axis, and to a second position, wherein the rocker arms are free to rotate relative to one another. An actuator assembly is operable, in response to an electrical input signal, to cause the movement of the latch means.

The improved valve control system is characterized by the actuator assembly including a housing and an arm member adapted for engagement with the latch means, and means biasing the arm member away from a first position, and toward a second position corresponding to the second position of the latch means. The actuator assembly includes an electromagnetic coil adapted to receive the electrical input signal, and an axially moveable armature having a retracted position and an extended position, one of the positions occurring in response to the electrical input signal. In the position of the armature which occurs in response to the electrical input signal, the armature biases the arm member toward the first position, in opposition to the force of the biasing means.

DETAILED DESCRIPTION OF THE PREFERRED EMBODIMENT

Figure 1:
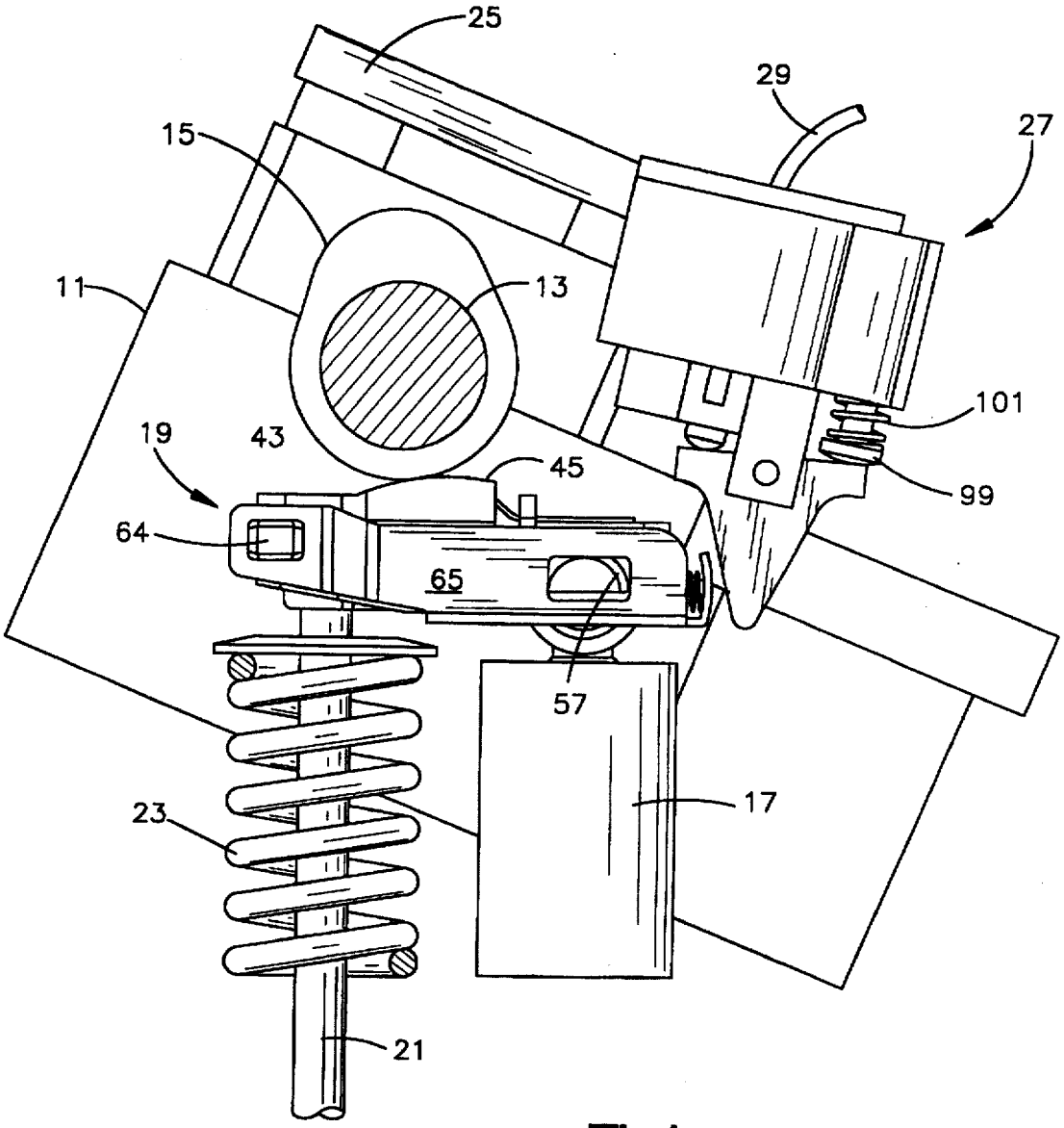
FIG. 1 is a cross-sectional view of the engine poppet valve control system of the present invention, installed in a valve train, illustrating the "high lift" mode of operation.

Referring now to the drawings, which are not intended to limit the invention, FIG. 1 illustrates a typical valve train of an internal combustion engine, but wherein the valve train includes the present invention. Shown in FIG. 1 is a fragmentary portion of an engine cylinder head 11 of the overhead cam type. Also shown is a cam shaft 13 including a high lift cam lobe 15, the specific design of which forms no part of the present invention. Disposed within the cylinder head 11 is an hydraulic lash adjuster 17 which acts as a pivot point for a latchable rocker arm (LRA) assembly, generally designated 19. Also shown in FIG. 1 is an engine poppet valve 21 (only the valve stem being shown herein), and a valve return spring 23.

Figure 2:
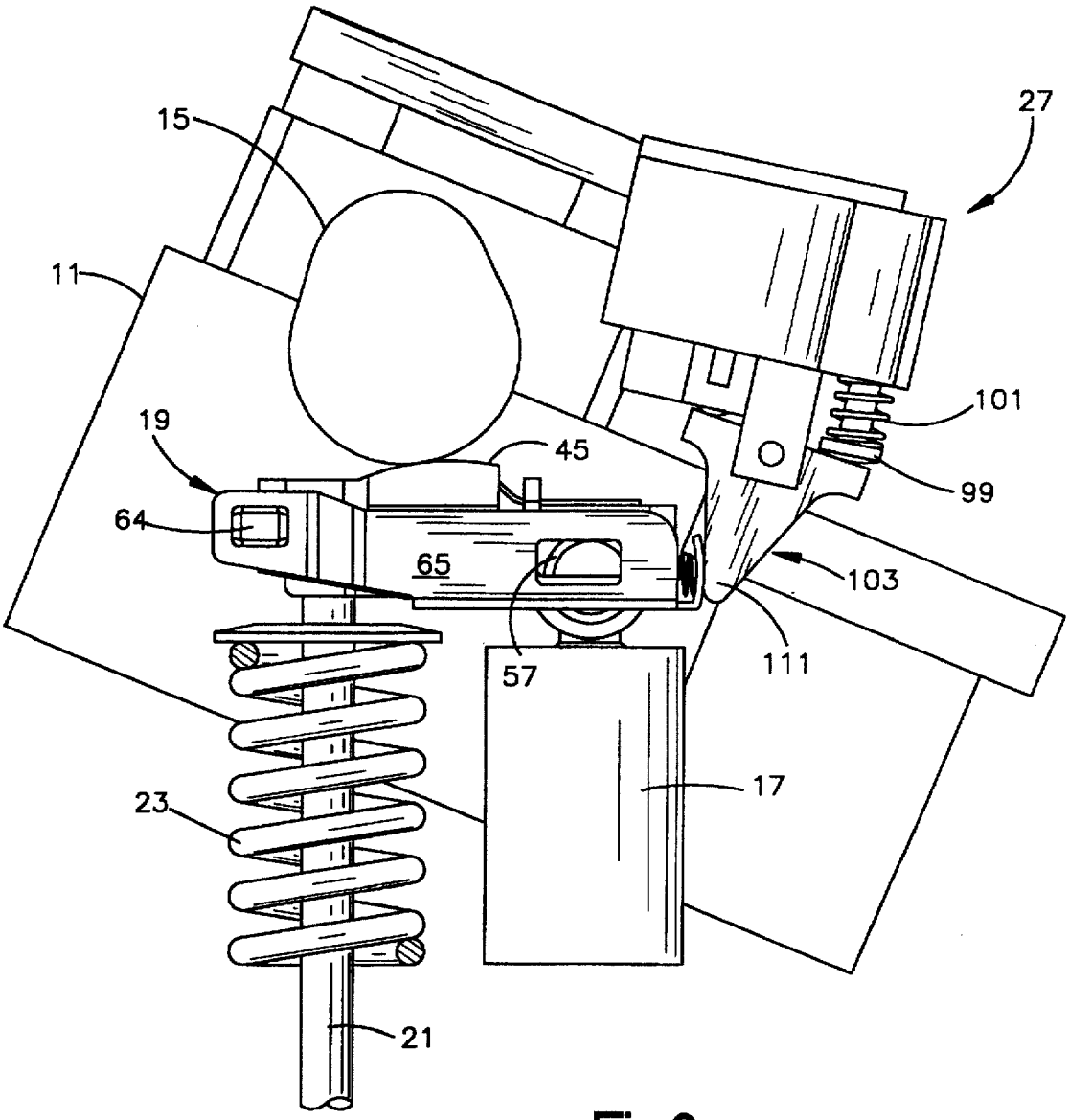
FIG. 2 is a cross-sectional view of the engine poppet valve control system, similar to FIG. 1, illustrating the "low lift" mode of operation.

As illustrated herein, the valve control system of the present invention is of the type which is particularly adapted to selectively activate the poppet valve 21, by means of the latchable rocker arm assembly 19, in either a "high lift" mode as shown in FIG. 1, or a "low lift" mode as shown in FIG. 2. In the high lift mode, the rocker arm assembly 19 is operable to achieve a relatively greater opening of the poppet valve 21, and in the "low lift" mode, the rocker arm assembly is operable to achieve a relatively smaller opening of the poppet valve 21. Although the poppet valve 21 is shown only fragmentarily in FIGS. 1 and 2, these views will be considered to represent an open position of the popper valve 21 because rotation of the cam shaft 13 from the position shown would result in the cam lobe 15 engaging the rocker arm assembly 19, and moving ("lifting") the poppet valve 21 downward, in opposition to the force of the return spring 23, in a manner well known to those skilled in the art.

Operatively associated with the latchable rocker arm assembly 19, and supported by a bracket 25, is a solenoid type actuator assembly 27 which is operable to shift the rocker arm assembly 19 between its high lift and low lift modes in response to the presence or absence, respectively, of an electrical input signal, represented in FIG. 1 by a pair of electrical leads 29, the numeral "29" also being used hereinafter for the input signal.

Figure 3:
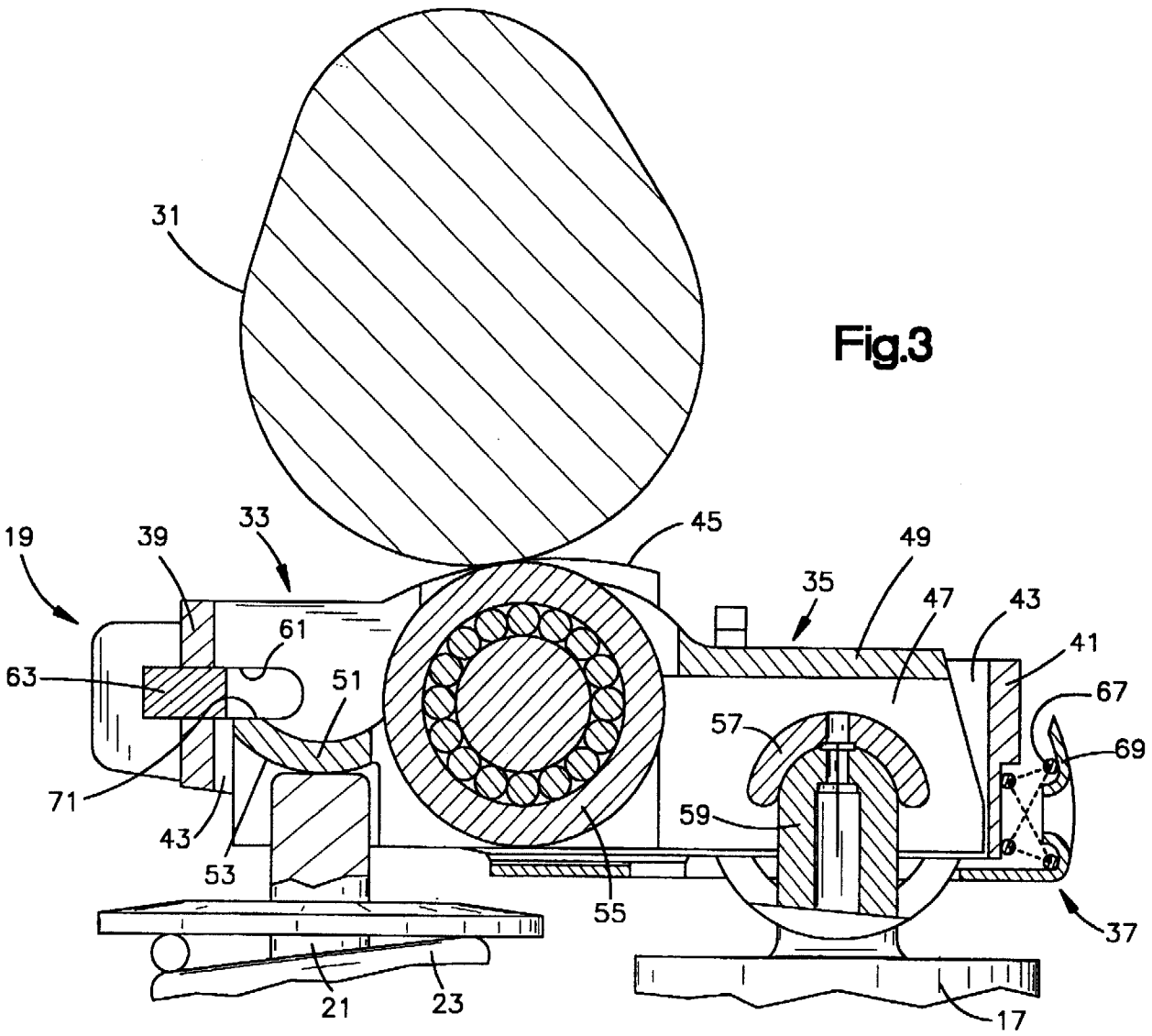
FIG. 3 is an axial cross-section of the latchable rocker arm assembly shown in side elevation view in FIGS. 1 and 2.

Referring now to FIG. 3, in conjunction with FIGS. 1 and 2, the latchable rocker arm assembly 19 will be described in greater detail. In the external plane view of the LRA in FIG. 1, the high lift cam lobe 15 is shown, but in the axial cross-section of FIG. 3, what is visible is a low lift cam lobe 31. In the subject embodiment, the "height" or "lift" (the distance from the axis of rotation of the cam shaft 13 to the surface of the lobe) is somewhat greater for the cam lobe 15 than for the cam lobe 31. This will be explained in greater detail subsequently. The LRA assembly 19 comprises an outer rocker arm 33 and an inner rocker arm 35. Finally, the LRA assembly 19 includes a slider mechanism 37.

The outer rocker arm 33 includes a forward wall 39 and a rearward wall 41. The walls 39 and 41 are interconnected by a pair of sidewalls 43 (only one of which is shown in FIG. 3, and the other of which is partly shown in FIG. 1). At the top of each of the side walls 43 is a sliding pad 45. Those skilled in the art will understand that there is one of the low lift cam lobes 31, but there are two of the high lift cam lobes 15, one of which is disposed on either side of the low lift cam 31, and each of the high lift cams 15 engages one of the sliding pads 45.

The inner rocker arm 35 includes a pair of side walls 47 (only one of which is shown in FIG. 3), the side walls 47 being interconnected by a connecting wall 49 near the rearward end of the inner rocker arm 35, and being interconnected by a valve stem pad 51, which includes a pad surface 53 in engagement with the upper end of the poppet valve 21. Disposed between the side walls 47 of the inner rocker arm 35 is a roller bearing assembly 55, which is in continuous engagement with the low lift cam lobe 31, serving as a cam follower element, but only during "low lift" operation. During operation in the "high lift" mode, the cam lobe 31 is out of engagement with the roller bearing 55 during operation off the base circle. Also disposed between the side walls 47, and in slotted engagement with both the outer and inner rocker arms 33, 35 is a fulcrum member 57 which remains in engagement as shown in FIG. 3 with a ball plunger 59 of the lash adjuster 17. As is well known to those skilled in the art, the engagement of the fulcrum member 57 on the ball plunger 59 serves as a fulcrum or pivot point for each of the rocker arms 33 and 35, relative to the fixed lash adjuster 17.

The outer rocker arm 33 defines a slot 61, and disposed therein is a latch 63 which is part of the slider mechanism 37, and as may best be seen in FIGS. 1 and 2, the slider mechanism 37 preferably includes a pair of side walls 65, having the latch 63 trapped between a pair of pockets 64 (only one is visible in either FIG. 1 or 2). In addition to being supported by the pockets 64, the latch 63 extends into the slot 61 in each adjacent side wall 43.

Disposed toward the rearward end of the LRA assembly 19, there is a helical compression spring 67 disposed between the rearward wall 41 and an engagement tab 69 comprising an upturned portion of the stamping which comprises the slider mechanism 37. The biasing force of the spring 67, acting against the forward surface of the tab 69, tends to bias the slider mechanism 37 to the right in FIG. 3. As the slider mechanism 37 moves right, the latch 63 moves to the right within the slot 61, until it reaches a position in which the latch 63 is engaging both the slot 61 and an upper surface 71 of the valve stem pad 51. In other words, in the position shown in FIG. 3, the rocker arms 33 and 35 are "unlatched", but as the latch 63 moves to the right and engages the surface 71, the rocker arms 33 and 35 then become "latched", as will be described in greater detail subsequently.

Figure 4:
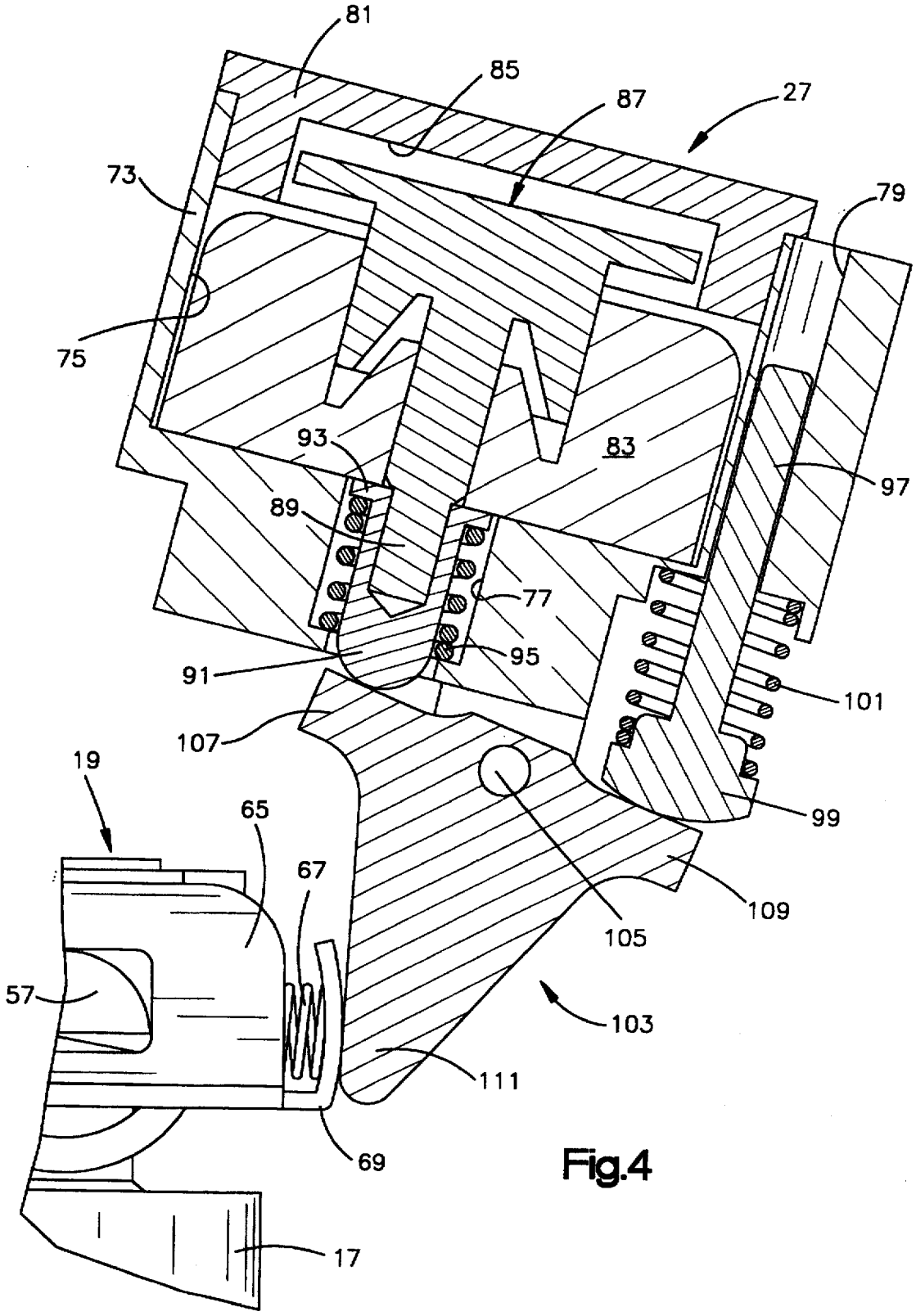
FIG. 4 is an enlarged, axial cross-section of the actuator of the valve control system shown in FIGS. 1 and 2.

Referring now to FIG. 4, in conjunction with FIGS. 1 through 3, the actuator assembly 27 will be described in some detail. In connection with the description of the solenoid-type actuator assembly 27, it should become apparent to those skilled in the art that, it is not the actuator itself and its structural details which are significant to the present invention, but instead, the way in which the actuator assembly 27 interacts with the LRA assembly 19.

The actuator assembly 27 includes a housing 73 which defines a large chamber 75, a smaller cylindrical chamber 77, and an elongated bore 79. The chambers 75 and 77 are coaxial, and the bore 79 is offset therefrom, but preferably has its axis parallel to that of the chambers 75 and 77.

The chamber 75 is enclosed by means of a cover member 81, and disposed within the chamber 75 is an electromagnetic coil 83, connected to the electrical leads 29, to be energized thereby in a conventional manner. The coil 83 and the cover member 81 cooperate to define an armature chamber 85, within which is disposed an armature assembly 87. The armature assembly 87 includes a plunger portion 89 which extends downwardly into the smaller chamber 77, and, at its lower end, is encased within a hardened tappet 91. Preferably, the tappet 91 is pressed onto the lower end of the plunger 89, and is included primarily to provide a durable wear surface, for reasons which will become apparent subsequently. Toward its upper end, the tappet 91 includes a flange portion 93 which serves as a seat for a helical compression spring 95, the function of which is to bias the armature assembly 87 upward, to the position shown in FIG. 4, whenever the electromagnetic coil 83 is not energized.

Disposed within the elongated bore 79, and closely spaced therein, is another tappet member 97 including a contact portion 99 which serves as the lower seat for a helical compression spring 101, the upper end of which is seated against a bottom surface of the housing 73. Thus, the spring 101 biases the tappet member 97 downwardly in FIG. 4.

The actuator assembly 27 also includes a generally T-shaped arm member, generally designated 103, which is pivotally mounted relative to the housing 73 at a pivot location 105. The arm member 103 includes a pair of input portions, oppositely disposed about the pivot location 105, including an input portion 107, the upper surface of which is engaged by the tappet 91, and an input portion 109, the upper surface of which is engaged by the contact portion 99 of the tappet member 97. Finally, the arm member 103 includes an output portion 111, which is, at least at certain times, in engagement with the engagement tab 69 of the slider mechanism 37, as shown in FIG. 4.

Operation

Referring now primarily to FIGS. 2, 3 and 4, when the electromagnetic coil 83 is de-energized, the spring 95 biases the tappet 91 and armature assembly 87 upward to the position shown in FIG. 4, as described previously. At the same time, the spring 101 biases the tappet 97 downwardly, causing the arm member 103 to pivot in the clockwise direction about the pivot location 105. The output portion 111 engages the tab 69, and biases the slider mechanism 37 to the left, toward the position shown in FIG. 3. It is one important feature of the present invention that the force of the spring 101 be sufficient to bias the arm 103 with sufficient force to overcome the biasing force of the spring 67. Thus, when the coil 83 is de-energized, the slider 37 is biased to the unlatched, low lift mode shown in FIG. 3, in which opening of the poppet valve 21 occurs solely in response to the rotation of the low lift cam lobe 31, and its engagement with the roller bearing 55, thus pivoting the inner rocker arm 35, and causing the pad 51 to "lift" the poppet valve 21, i.e., move it downward in opposition to the biasing force of the spring 23.

When the coil 83 is energized, it exerts sufficient force on the armature assembly 87 to bias it downward in FIG. 4, overcoming the biasing force of the spring 95. It is one important aspect of the present invention that the actuator 27 does not have to exert enough force to overcome, by itself, the biasing force of the spring 101 (which is also referred to as the "energy" spring). Instead, the force on the arm member 103, tending to rotate it counter-clockwise, which is exerted by the coil 83 and armature 87, is aided by the force of the spring 67. As the armature assembly 87 moves downward in FIG. 4, the air gap between the coil 83 and the armature 87 is reduced, thereby enabling the energized coil 83 to exert an increasing downward force on the armature 87, until sufficient force is exerted on the armature to overcome the force of the spring 101, and the arm member 103 is rotated out of contact with the tab 69 to the position shown in FIG. 1. By way of example only, the biasing force of the spring 67 is about one-half the biasing force of the spring 101. This arrangement enables the coil 83 to be smaller, and consume less electrical energy than would otherwise be the case.

In this condition, the force of the spring 67 is sufficient to bias the slider 37 from its unlatched position shown in FIG. 3, to the latched position described previously, as shown in FIG. 1, in which the latch 63 engages the upper surface 71 of the pad 51. In this latched condition, when the high lift cam lobe 15 engages the sliding pads 45 on the outer rocker arm 33, the two rocker arms 33 and 35 now rotate in unison (because they are latched), thus achieving the high lift opening of the poppet valve 21 (because the cam lobe 15 has a greater "lift" than does the cam lobe 31).

In accordance with one important aspect of the present invention, during operation in the high lift mode, which is normally at relatively high engine speed, the arm member 103 is out of contact with the slider tab 69 (FIG. 1). Thus, the rubbing contact and wear between the arm member 103 and the tab 69, which would normally occur, are eliminated.

In order to change from the high lift mode of FIG. 1 to the low lift mode of FIG. 2, all that is required is to de-energize the coil 83, and the spring 95 will again bias the armature 87 upward to the position shown in FIG. 4, while the spring 101 will bias its input portion 109, and rotate the arm member 103 clockwise, overcoming the spring 67, and again moving the slider 37 to the unlatched, low lift mode shown in FIG. 3.

Thus it may be seen that the valve control system of the present invention includes a rocker arm assembly which is, in and of itself, normally biased to the high lift mode, and an actuator assembly which, in the absence of an input signal to energize the coil, is biased to a position which causes the rocker arm assembly to operate in the low lift mode. Thus, in the event of an electrical failure, the poppet valve 21 will operate only in the low lift mode. As is well known to those skilled in the art, in a dual lift valve control system, the low lift cam is optimized for low speed engine operation, while the high lift cam is optimized for high speed engine operation. With such an engine, the amount of valve opening in the high lift mode would result in substantially increased emissions at engine idle, and the engine would run rough or, possibly, not even start.

It is believed to be within the ability of those skilled in the art to select appropriate springs 67, 95, and 101, having appropriate spring forces, to permit operation of the valve control system in the manner described above. Similarly, it is believed to be within the ability of those skilled in the actuator art to select appropriate parameters for the coil 83 and the armature 87 to be able to achieve appropriate levels of force on the armature, at various points in its movement from the de-energized position of FIG. 4 to the fully energized position of FIG. 1.

The invention has been described in great detail in the foregoing specification, and it is believed that various alterations and modifications of the invention will become apparent to those skilled in the an from a reading and understanding of the specification. It is intended that all such alterations and modifications are included in the invention, insofar as they come within the scope of the appended claims.

We claim:

1. A valve control system for an internal combustion engine including a cylinder head, a poppet valve moveable within the cylinder head between one condition and another condition; and a camshaft including a cam lobe having a cam profile formed thereon; said control system comprising a first rocker arm mounted relative to the cylinder head for rotation about an axis; a second rocker arm mounted relative to the cylinder head for rotation about said axis, one of said rocker arms being engageable with said poppet valve and one of said rocker arms having a cam follower element thereon engageable with said cam lobe; and latch means operable, in response to movement in a direction perpendicular to said axis, to a first position, to achieve mutual engagement of said first and second rocker arms, for rotation in unison about said axis, and to a second position, wherein said rocker arms are free to rotate relative to one another; an actuator assembly operable, in response to an electrical input signal, to cause said movement of said latch means; characterized by:

(a) said actuator assembly including a housing and an arm member adapted for engagement with said latch means, and means biasing said arm member away from a first position, and toward a second position corresponding to said second position of said latch means;

(b) said actuator assembly including an electromagnetic coil adapted to receive said electrical input signal, and an axially moveable armature having a retracted position and an extended position, one of said positions occurring in response to said electrical input signal; and (c) in said position of said armature occurring in response to said electrical input signal, said armature biases said arm member toward said first position in opposition to the force of said biasing means.

2. A valve control system as claimed in claim 1, characterized by said arm member comprising a member including an output portion, adapted for engagement with said latch means, and an input portion, said output and input portions being joined at a pivot location, whereby said arm member is pivotable relative to said housing.

3. A valve control system as claimed in claim 2, characterized by said arm member being generally T-shaped, and said pivot location being disposed intermediate first and second opposite ends of said input portion, said output portion comprising the vertical portion of said T-shaped arm member.

4. A valve control system as claimed in claim 3, characterized by said pivot location being disposed transversely between said means biasing said arm member and said axially moveable armature.

5. A valve control system as claimed in claim 4, characterized by said axially moveable armature is adapted to engage said first input portion, to bias said arm member toward said first position, and said means biasing said arm member engages said second input portion to bias said arm member toward said second position.

6. A valve control system as claimed in claim 5, characterized by said means biasing said arm member comprises a helical compression spring having its opposite ends seated against said housing and a seat engaging said second input portion, said compression spring exerting a force X.

7. A valve control system as claimed in claim 6, characterized by said axially moveable armature including means biasing said armature toward said retracted position, away from engagement with said first input portion, said means biasing said armature comprises a helical compression spring exerting a force Y, said force Y being substantially less than said force X.

8. A valve control system as claimed in claim 7, characterized by said axially moveable armature moves to said extended position, in opposition to said force Y of said helical compression spring, in response to said electrical input signal.

9. A valve control system as claimed in claim 1, characterized by said latch means including means biasing said latch means toward said first position, to achieve said mutual engagement of said first and second rocker arms, said biasing means exerting a force on said arm member toward said first position, aiding the biasing force of said armature and opposing the biasing force of said means biasing said arm member.

10. A valve control system as claimed in claim 9, characterized by the biasing force of said armature on said arm member is sufficient whereby, when said arm member is in said first position, said arm member is out of engagement with said latch means.

11. A valve control system as claimed in claim 1, characterized by said camshaft including a high lift cam lobe and a low lift cam lobe, said first rocker arm including a high lift follower element in engagement with said high lift cam lobe, and said second rocker arm including a low lift follower element in engagement with said low lift cam lobe.

12. A valve control system as claimed in claim 11, characterized by said first position of said latch means, and said mutual engagement of said rocker arms corresponds to operation in a high lift mode, and said second position of said latch means, and said rocker arms being free to rotate relative to one another corresponds to operation in a low lift mode, whereby said means for biasing said arm member, in the absence of said electrical signal to said coil, biases said latch means toward said low lift mode of operation.

* * * * *